US005879095A

United States Patent [19]

Gueret

[11] Patent Number: 5,879,095

[45] Date of Patent: Mar. 9, 1999

[54] DISPENSER FOR A PRODUCT OF LIQUID-TO-PASTY CONSISTENCY, EQUIPPED WITH AN APPLICATION TIP

[75] Inventor: Jean-Louis Gueret, Paris, France

[73] Assignee: L'Oreal, Paris, France

[21] Appl. No.: 957,388

[22] Filed: Oct. 23, 1997

Related U.S. Application Data

[63] Continuation of Ser. No. 568,323, Dec. 6, 1995, abandoned.

[30] Foreign Application Priority Data

Dec. 6, 1994 [FR] France ..... 94-14652
Dec. 6, 1994 [FR] France ..... 94-14653

[51] Int. Cl.[6] ..... A45D 40/06; A45D 40/00

[52] U.S. Cl. ..... 401/172; 401/78; 401/174; 401/262; 401/263; 401/266; 401/77

[58] Field of Search ..... 401/78, 171, 172, 401/174, 263, 266, 262, 77, 76

[56] References Cited

U.S. PATENT DOCUMENTS

| | | | |
|---|---|---|---|
| 1,252,719 | 1/1918 | Proctor | 401/174 |
| 2,196,379 | 4/1940 | Bender | 401/266 X |
| 2,232,140 | 2/1941 | Rupp | 401/263 |
| 2,283,463 | 5/1942 | Rupp | 401/263 |
| 2,374,065 | 4/1945 | Worthington . | |
| 2,442,503 | 6/1948 | Melnikoff . | |
| 2,448,033 | 8/1948 | Kruck | 401/266 X |
| 2,629,889 | 3/1953 | Lengyel . | |
| 2,961,679 | 11/1960 | Claypool | 401/266 |
| 3,256,980 | 6/1966 | Bau | 401/174 X |
| 4,002,182 | 1/1977 | Michel | 401/266 X |
| 4,090,647 | 5/1978 | Dunning | 401/263 X |
| 4,323,157 | 4/1982 | Idec . | |

FOREIGN PATENT DOCUMENTS

| | | | |
|---|---|---|---|
| 3518709 | 11/1986 | Germany | 401/266 |
| 3526109 | 1/1987 | Germany . | |
| 4016353 | 5/1989 | Germany . | |
| 437926 | 7/1948 | Italy | 401/172 |

*Primary Examiner*—Steven A. Bratlie
*Attorney, Agent, or Firm*—Young & Thompson

[57] ABSTRACT

The present invention relates to a unit (1) for dispensing and applying a product (P) of liquid-to-pasty consistency, comprising a tubular reservoir (2) for containing the product to be dispensed, communicating with at least one dispensing orifice (61), this reservoir, on the opposite side from the orifice (61) including at least one longitudinal slot (21); a piston (4) capable of sliding in translation inside the reservoir (2) including a complementary drive stud (43) passing through the slot (21); a base part (9) connected to the reservoir; screw thread (51) for translational drive of the piston (4). The reservoir (2) and the base part (9) are made as a single piece, the slot (21) being made on just part (2*b*) of the reservoir (2). This unit is equipped with an application tip (6) for dispensing and applying the product (P) including an application surface (63) provided with the dispensing orifice (61). The application surface (63) of the tip (6) may include at least one cavity or at least one groove (75), the orifice (61) being situated in this cavity or groove.

27 Claims, 7 Drawing Sheets

DISPENSER FOR A PRODUCT OF LIQUID-TO-PASTY CONSISTENCY, EQUIPPED WITH AN APPLICATION TIP

This application is a continuation of application Ser. No. 08/568,323, filed Dec. 6, 1995, now abandoned.

FIELD OF THE INVENTION

The present invention relates to a dispensing unit for applying a product of liquid-to-pasty consistency to a support, equipped with an application tip. This dispensing unit is especially intended for applying a cosmetic product to the skin or to the mucosae, but is can also be used in other technical fields for dispensing a viscous product, for example a glue. More specifically, the invention is aimed at dispensing and applying a lipstick or lip-balm composition of creamy consistency, or a skin-treatment cream.

BACKGROUND OF THE INVENTION

In general, a make-up unit for the lips includes a product in the form of a stick of substantially solid consistency, a moving support, known as a cup, accommodating the product to be applied, a casing and a mechanism allowing the stick to be housed during the storage period, and allowing it to be taken out of its casing with a view to applying the product to the lips.

The structure of this conventional mechanism is however often quite complicated, requiring specialized assembly tooling. Furthermore, the manufacture of a lipstick requires the successive steps of: hot-moulding the stick, releasing from the mold under vacuum, flaming the surface of the stick, and fixing it into a cup. In addition, it is tricky to assemble the cup equipped with the stick owing to the fragility of the stick. Owing to this specialized tooling and to these various manufacturing steps, the cost of such a lip product is high. Moreover, a conventional lipstick unit of this type is not very well able to withstand impacts, for example, during transportation in a handbag. Such a lipstick unit is particularly susceptible to impacts during hot weather.

In order to avoid these drawbacks, there are; a dispensing units for applying products of liquid-to-pasty consistency. This type of product makes it possible to use dyes and/or excipients which are currently not envisageable for this use.

FR-A-1,323,631 discloses a dispenser of cream for skincare, including: a cylindrical body, a cylindrical piston equipped with radial studs located in this body, an operating ring mounted freely and rotatably at the lower part of the body, an outer cylindrical protective casing equipped with a dispensing orifice, an intermediate cylindrical casing equipped with helical grooves and integral with the outer casing, and an internal cylindrical casing integral with the operating ring and equipped with axial slots and also mounted freely and rotatably in the intermediate casing. The piston is mounted so that it can slide inside the internal casing which contains the product to be dispensed, in such a way that the studs pass through the slots to interact with the helical grooves of the intermediate casing. By turning the operating ring, the piston is raised by rotating the intermediate casing, thus dispensing of the product.

This prior art dispenser is limited to products of highly viscous consistency, because a product of liquid consistency would escape through the slots, obstructing the manipulation of the mechanism owing to the soiling of the helical grooves.

Moreover, U.S. Pat. No. 4,323,157 discloses an applicator for cosmetic products of elongate shape having a dispensing orifice cut at an angle. This applicator is designed for the application of an extruded solid product such as a conventional stick of lipstick, and cannot be used for dispensing a liquid product. The dispensing of the product is controlled by a mechanism which can be actuated with just one hand by the user. However, during this actuation, the orientation of the orifice at an angle changes, so that it is not possible to apply make-up to the lips without turning the applicator in one's hand in order to have a correct orientation, for example by using the other hand.

U.S. Pat. No. 2,442,503 also discloses an applicator of liquid lipstick equipped with a supple tip. The dispensing mechanism of this applicator does not allow the product to be dispensed easily by actuation with just one hand.

U.S. Pat. No. 2,374,065 describes an application tip having an application surface including a plurality of orifices, this tip being made of rigid plastic. Application of the product to the lips is therefore lacking in comfort. Furthermore, the application of make-up obtained is uneven and streaky. In addition, the dispensing of the product cannot be controlled with one hand. Furthermore, the product is packaged so that it is in contact with the drive system, leading to a soiling of the latter which may make the applicator unusable.

SUMMARY OF THE INVENTION

The applicant has sought to avoid the above drawbacks by creating a dispensing unit for applying liquid-to-pasty products the viscosity of which lies within a wide range. The unit thus makes it possible to use novel raw materials, whilst providing for an accurate and pleasing application of make-up. Moreover, the applicant has sought to produce a dispensing unit of simple construction which does not become soiled under the effect of the liquid product to be dispensed, is easy to mold and to package, and is therefore of attractive price. The dispensing unit proposed by the applicant is furthermore practical to use, it being possible for it to be manipulated with just one hand.

These objectives are achieved by a dispensing unit equipped with an application tip of given shape, made from a supple elastomeric material. The applicant has found that by choosing such a tip it is possible to obtain a deep and shiny application of make-up to the lips. Furthermore, by providing cavities or spreading grooves in the application surface of this tip it is possible to obtain more quickly an application of make-up which is more even than with an application brush. In addition, these grooves or cavities in the application surface of the tip allow the applicator to absorb any excess product deposited on the lips. In particular, the product is dispensed by a mechanism which can be actuated with just one hand, the actuation of which does not change the orientation of the application tip.

In consequence, the invention relates to a unit for dispensing and applying a product of liquid-to-pasty consistency, comprising: a tubular reservoir for containing the product to be dispensed communicating with at least one dispensing orifice, this reservoir including, on the side opposite from the orifice, at least one longitudinal slot; a piston capable of sliding in translation inside the reservoir, including translational-drive means passing through the slot and providing for the dispensing of the product; a base part connected to the reservoir; means for translational drive of the piston, the reservoir and the base part being made as a single piece and the slot being made on just part of the reservoir. According to the invention, this unit furthermore includes an application tip integral with the reservoir equipped with the dispensing orifice.

The expression "product of liquid-to-pasty consistency" is intended to mean any composition capable of flowing under the action of a dispensing means exerting a thrust on this product, capable of expelling the product through the dispensing orifice.

This product advantageously has a viscosity lying within the range ranging from 0.6 Pa.s to 17 Pa.s.

For preference, the drive means consist of an operating ring surrounding at least part of the reservoir and mounted so as to be fixed in terms of translation and free in terms of rotation about this reservoir, this ring being equipped internally with a helical drive element, and with a complementary drive element integral with the piston passing through the slot and capable of sliding in translation inside the slot, this helical drive means and this complementary drive means being arranged so that a rotation of the manipulation ring gives rise to a translation of the piston to provide for the dispensing of a dose of the product.

Furthermore, means for retaining the piston in the reservoir may be provided to prevent the complementary drive means of the piston from coming out of the slot in which it is located.

To this end, the base part includes an open end, the retaining means advantageously consisting of a plug designed to close off this end, it being possible for the plug to support a skirt a free end of which is intended to come to bear against the limit stop means.

For preference, the drive element consists of an internal screw thread of the ring, and the complementary drive element then consists of an external screw thread borne by the piston, this external screw thread complementing the internal screw thread of the ring. The ring advantageously includes a cylindrical skirt equipped internally with a groove or with an annular rib capable of interacting with a complementary rib or groove, borne by the base part. This ring is thus fixed in terms of translation and free in terms of rotation.

According to another possible embodiment, the drive element may consist of at least one helical groove made in the internal wall of the operating ring and the complementary drive element then consists of at least one stub borne by the piston, the stub passing through the slot and being capable of sliding in the helical groove.

The piston includes a cylindrical skirt equipped with a circular wall in contact with the product, the translational-drive means on the opposite side to the product being arranged so that when these drive means are situated at the lower end of the slot, the circular wall of the piston is situated above the upper end of the slot.

According to a specific embodiment, the application tip may include an application surface equipped with at least one dispensing orifice, the application surface of the tip including at least one cavity or at least one groove, the orifice being situated in this cavity or in this groove.

According to an attractive embodiment, this tip is shaped substantially into the form of an ogive equipped with an application surface which is flat, slightly concave, or slightly convex, situated at an angle (askew) on the flank of the ogive, equipped with at least one dispensing orifice.

For preference, the cavity or the groove is extended parallel to the application surface, which may be flat, concave or convex, by passages so as to create channels for the product to spread out as it is applied to the support. In the case where these passages are made in a concave or convex surface, the term "parallel" is intended to mean passages cut into the application surface at a substantially constant depth.

According to one alternative embodiment, the application surface may consist of a mesh. This application surface may advantageously include two series of woven threads, the threads of one series crossing over those of another series, especially in two orthogonal directions. The application surface thus includes a multitude of dispensing orifices. When a multitude of such orifices is provided, their cross-section may be variable, and of different shape.

According to another alternative embodiment, the application surface may include a multitude of points separated by a multitude of cavities communicating with each other, at least some of the cavities being equipped in their bottom with at least one dispensing orifice intended to communicate with a reservoir containing the product to be dispensed.

According to another alternative embodiment, the application tip may be equipped with an application surface intended to come into contact with the lips, including roughnesses evenly distributed over all or part of the surface-area of this surface.

The channels located in the application surface may be straight or curved, and in particular form closed curves.

In order to confer a softness of application, and suppleness, the tip may advantageously be made of a supple substance, for example of an elastomeric material chosen from the group of elastomers of polyethylene, of polyurethane, of polyester, polyether-block-amides, polyvinyls, terpolymers of ethylene, of propylene and of a diene (EPDM), styrene-butadiene block copolymers (SEBS-SIS), silicones, nitrile rubbers, latexes, etc. These materials have the advantage of spreading-out and smoothing the product well when it is applied to the support. Advantageously, the elastomeric material has a Shore A hardness lying within the range from 40 to 70.

This dispenser may include a removable protective cap. In this case, the application tip advantageously includes an annular sealing bead over which the protective cap is push-fifted.

The dispensing and application unit which has just been described is more particularly intended for applying a product for the lips. Also, according to one particularly attractive embodiment of the invention, the application tip is shaped substantially into the form of an ogive equipped with a flat or slightly domed application surface situated at an angle on the flank of the ogive, equipped with at least one dispensing orifice, so as to imitate the shape of conventional lipsticks, with a solid stick, before any application. The advantage of a non-deformable semirigid tip over a deformable stick is that it keeps its shape until the tube of lipstick or lip balm has run out, and that it therefore provides for an accurate and even application of make-up, right to the end.

This application tip advantageously includes a closure system which opens under the thrust of the product and prevents the surrounding air from entering the reservoir when dispensing is not taking place, instantaneously halting the flow of the product after dispensing.

This dispensing unit of the invention confers upon application a great comfort of softness and displays good properties of spreading out and smoothing the product onto the lips, while being capable of absorbing any surplus product. It may be manipulated with just one hand. The application of make-up obtained is accurate and shiny.

BRIEF DESCRIPTION OF THE DRAWINGS

In addition to the provisions explained hereinabove, the invention consists in a certain number of other provisions which will be dealt with more fully herein below, with regard to embodiments described with reference to the appended drawings, which are in no way limiting.

DESCRIPTION OF THE PREFERRED EMBODIMENTS

Referring to FIGS. 1 to 4 of the drawings, it is possible to see a unit 1 for dispensing and applying a product P of liquid-to-pasty consistency, comprising a tubular reservoir 2 containing the product to be dispensed. This product is, in particular, a lipstick having a viscosity ranging from 0.6 Pa.s to 17 Pa.s, and preferably from 2 Pa.s to 10 Pa.s.

Figure 2:
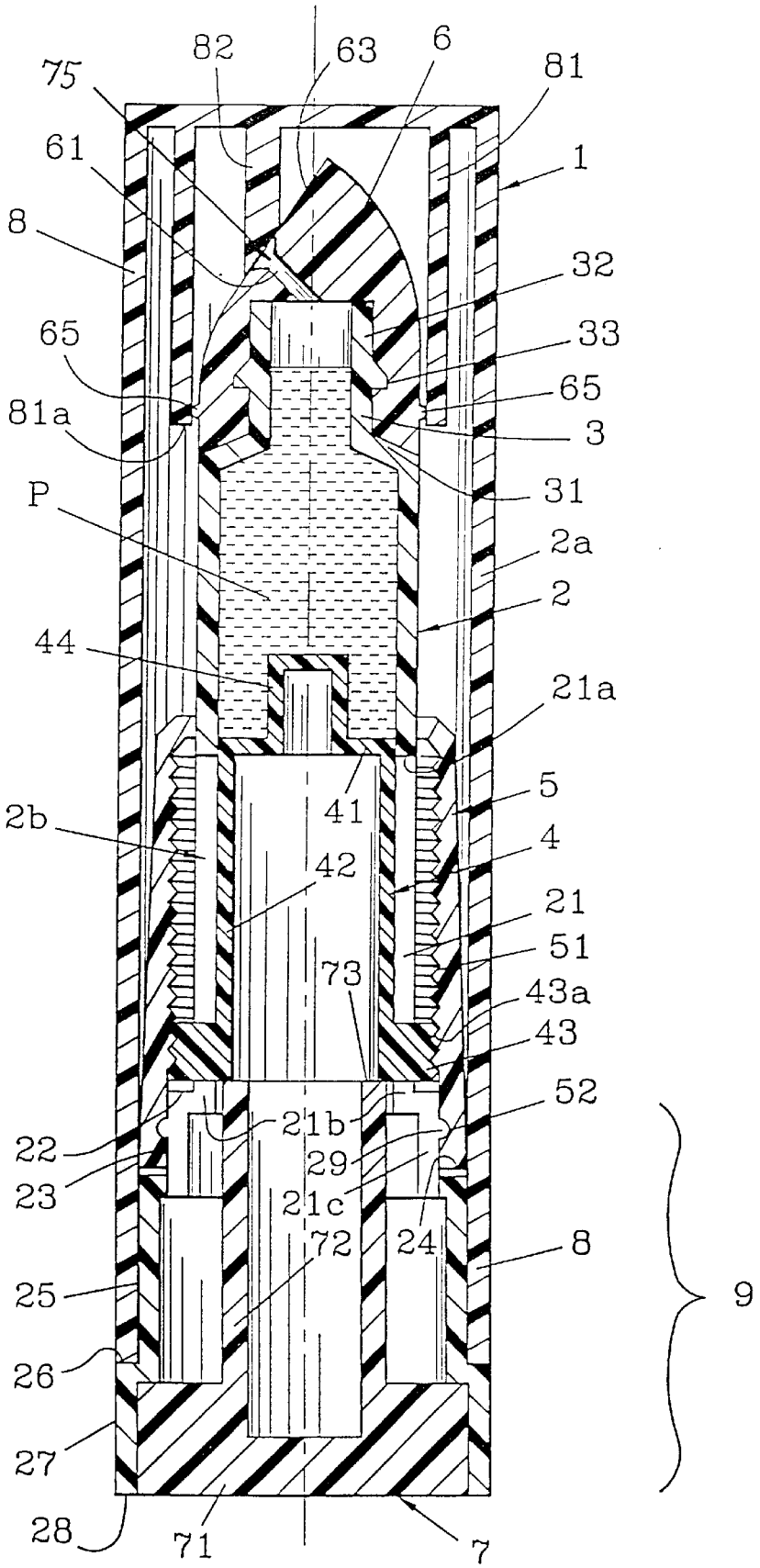
FIG. 2 is an axial section through the dispensing unit of FIG. 1, before first dispensing.
Figure 3:
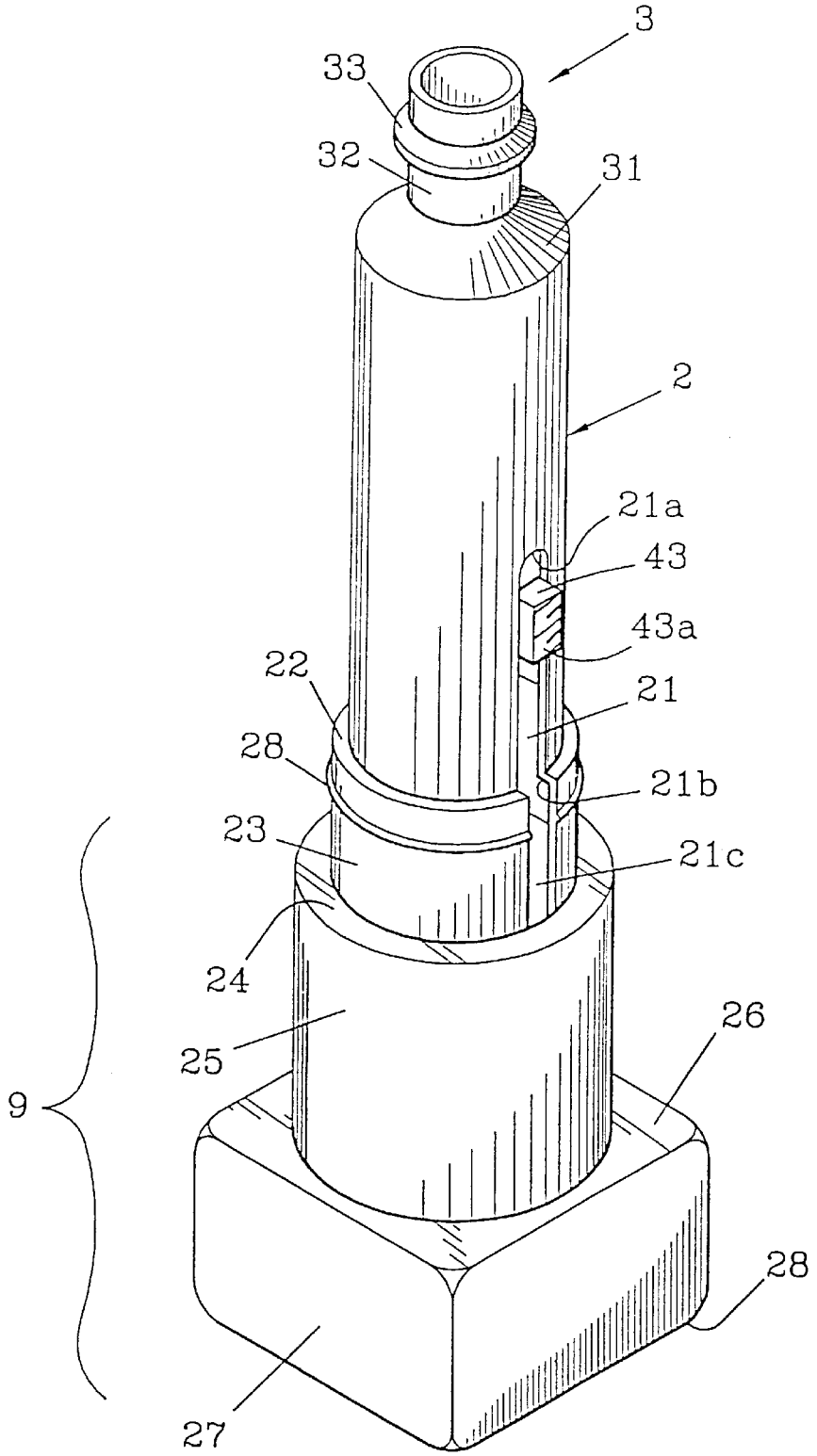
FIG. 3 is an enlarged view of the reservoir of the unit of FIG. 1.
Figure 4:
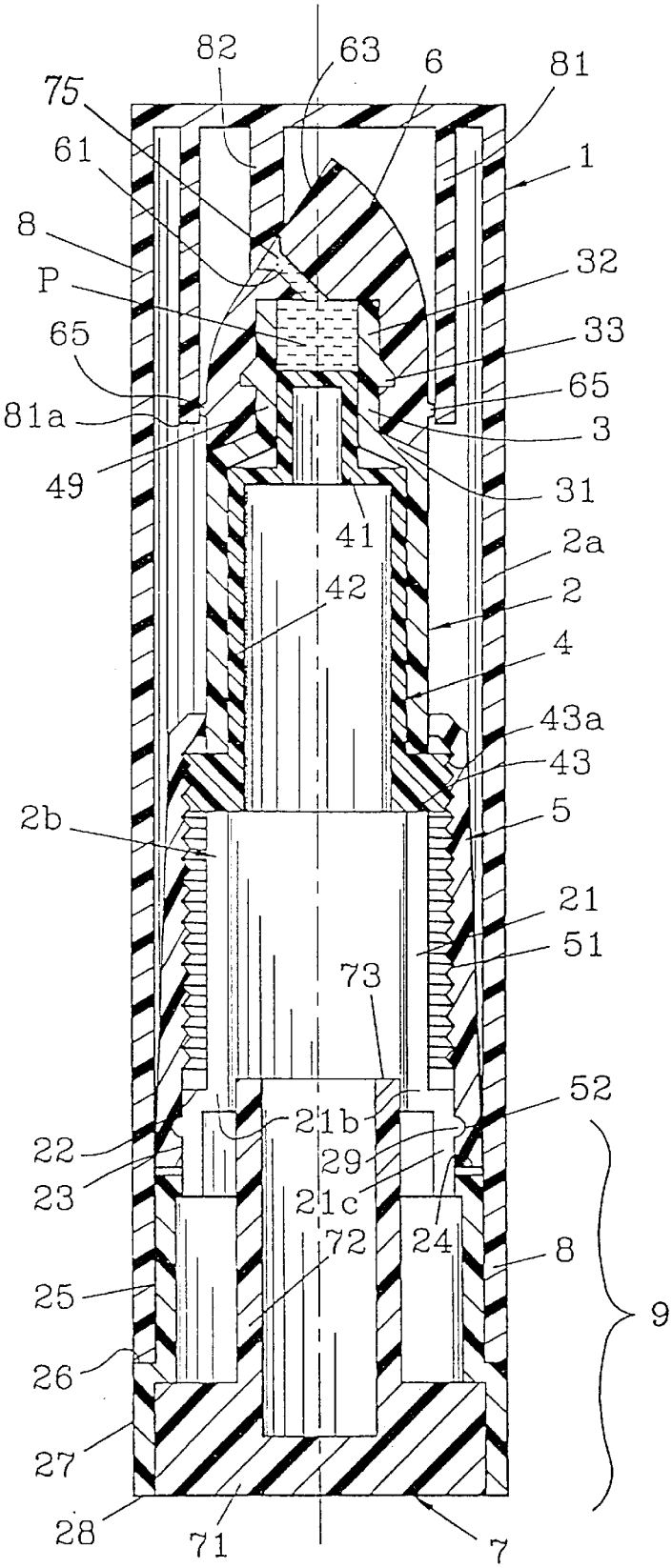
FIG. 4 is an axial section through the dispensing unit of FIG. 1, at the end of dispensing.

As can be seen especially in FIG. 2, the reservoir 2 includes two parts, namely an upper part 2*a* containing the product P and a lower part 2*b* in which a cylindrical piston 4 is slidably mounted. This piston has a circular wall 41 in contact with the product P. The free end of the part 2*a* of the reservoir includes a reducing region 31 in the shape of a cone frustum extended into a cylindrical neck 32. This neck 32 is covered by an application tip 6 substantially in the form of an ogive having a flat or slightly domed application surface 63 situated at an angle (askew) on the flank of the ogive. At least one orifice 61 is provided in the application surface 63, situated at the bottom of a cavity 75, in communication with the neck 32 of the reservoir 2. Advantageously, the surface 63 includes roughnesses 64 making it easier to spread out the product P.

Advantageously, the application tip 6 is made of a supple elastomeric substance. On the same side as the piston 4, the part 2*b* includes at least one longitudinal slot 21, revealing at least one stud 43 integral with the piston 4 and extending radially therefrom. At the bottom part, the part 2*b* is connected by an annular limit stop 22 to a cylindrical portion 23, the internal cross-section of which is slightly greater than the external cross-section of the reservoir 2. The slot 21 extends downwards over the entire length of the cylindrical portion 23. A parallelepipedal base 27 is connected to the cylindrical portion 23 by a cylindrical portion 25, the internal cross-section of which is substantially equal to the external cross-section of this cylindrical portion 23, thus forming an annular limit stop 24. The parts 22 to 27 constitute the base part 9 of the dispensing unit.

The base part is connected to the reservoir and on the inside has at least one region of substantially greater cross-section than the reservoir so as to form limit stop means and allow the complementary drive stud 43 of the piston 4 to pass into the slot 21, this region extending as far as the slot, that is to say this arrangement allows the piston to be introduced into the reservoir.

The free end of the base 27 includes an opening 28 by means of which the piston 4 may be introduced into the reservoir 2. After the piston has been thus introduced, the opening 28 is closed off by a plug 7, including an end 71 (of any shape) equipped with a central skirt 72 the free end 73 of which extends as far as the level of the annular limit stop 22, and bears against the piston 4 in the bottom position, preventing it from coming out of the reservoir 2.

This arrangement of the piston 4 in the reservoir 2 provides perfect sealing between the upper part 2*a* and lower part 2*b* of the reservoir 2, allowing the product P to be stored protected from the surrounding air. If appropriate, the piston 4 may be fitted with an O-ring capable of sliding in the upper part 2*a* of the reservoir 2, which may be advantageous for dispensing liquids of low viscosity, or volatile products. Furthermore, during packaging or dispensing the product P cannot escape from the reservoir; the soiling of the dispensing mechanism of this unit is thus avoided. In order to minimize losses of product at the end of dispensing, the circular wall 41 of the piston 4 carries a cylindrical cover 44 capable of filling the internal volume of the neck 32 at the end of its travel.

An operating ring 5 of cylindrical shape, having an axial length slightly greater than that of the part 2*b* of the reservoir 2 is freely rotatably mounted on this part 2*b*. A snap-fit bead 29 formed on the cylindrical portion 23 interacts with an internal annular groove 52 of the ring 5, holding the ring in place.

An internal part of the ring 5, facing the slot 21, includes a screw thread 51 capable of interacting with a complementary screw thread 43*a* on the free end of the stud 43.

A protective cap 8 is provided, intended to come into abutment against a step 26 formed between the base 27 and the cylindrical portion 25. The cross-section of this protective cap 8 may be circular, or it may have the same shape as the cross-section of the base 27. The cap 8 carries a cylindrical internal skirt 81 the free end 81*a* of which is pressed in a sealing fashion against an annular bead 65 integral with the application tip 6. The cap 8 additionally includes a stub 82 situated inside the skirt 81 and intended to close off the dispensing orifice 61, or to disable a dispensing valve (66, 66B see FIGS. 6 and 7).

The constituent components of the dispensing unit are easy to mold. In order to assemble them, one begins by introducing the piston 4 into the opening 28 of the base 27, causing the studs 43 of the piston to slide in the slots 21. The plug 7 is forcibly inserted into the opening 28, the skirt 72 thus preventing the piston 4 from coming out of the reservoir 2. Next, the operating ring 5 is snap-fitted from above over the annular limit stop 22. By turning the ring 5 by one or two turns, the screw threads 43*a* of the studs 43 are engaged in the internal screw thread 51 of the operating ring. The product P is then introduced into the reservoir 2, possibly in the hot state, via the neck 32. Subsequently, the applicator tip 6 and the protective cap 8 are fitted. The dispensing unit is ready for use.

According to another possibility, the reservoir 2 is filled via the opening 28: the assembly comprising the reservoir 2/piston 4/applicator 6 is inverted. In this case, the product P is poured in the hot state through an orifice (not represented) made in the circular wall 41 of the piston. After filling, this orifice is closed off by a thin cover disc.

To apply make-up to her lips, the user, after having removed the protective cap 8, takes hold of the dispensing unit in one hand, gripping the operating ring between thumb and index finger, the other fingers gripping the base part 9. By turning the ring 5, a dose of product is accumulated around the dispensing orifice 61. By applying the application surface 63 to her lips, the user easily and accurately spreads out the product; the application of make-up obtained is pleasing, even and shiny.

Figure 5:
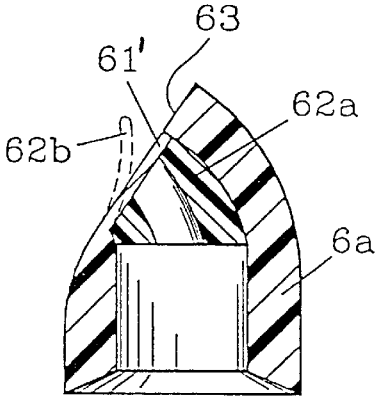
FIG. 5 is an axial section through an alternative application tip with a valve which may be part of the dispensing unit of FIG. 1.

FIG. 5 represents, in longitudinal section, a supple application tip 6*a* whose application surface 63 includes a cut-out so as to form a one-way valve 62B bearing, in the position of rest of the dispensing unit, against a rigid insert 62*a* and moving away under the thrust of the product upon dispensing (position 62*b*).

Figure 6:
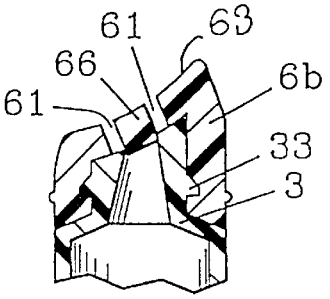
FIG. 6 is an axial section through another alternative application tip with a valve which may be part of the dispensing unit of FIG. 1.

FIG. 6 represents, in longitudinal section, a supple application tip 6*b* whose application surface 63 is convex and includes a plurality of orifices 61. The application surface 6*b* furthermore includes a closure point in the shape of a cone frustum which, in the position of rest, closes off the neck 3 of the reservoir, lifting under the thrust of the product P and when dispensing is ceased instantaneously halting the dispensing.

Figure 7:
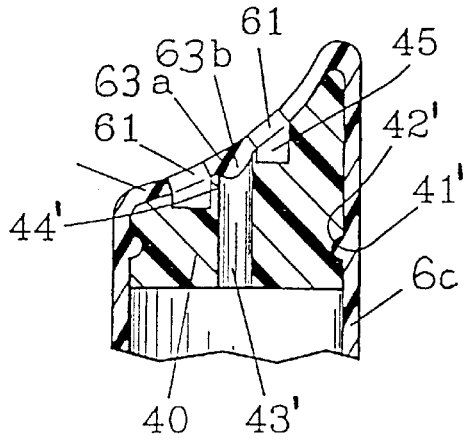
FIG. 7 is a view in longitudinal section of another alternative application tip including a one-way dispensing valve.

FIG. 7 represents an application tip 6*c* equipped with a one-way dispensing valve 63*b*, 44' and including a concave application surface 63 endowed with four dispensing orifices 61. This tip 6*c* includes a rigid or semi-rigid insert 40 equipped with a passage 43' for the product, this insert being in close contact with the internal wall of the application surface 63. This insert 40 includes an annular groove 45 connecting the dispensing orifices 61 together. A tube 44' separates the annular groove 45 from the passage 43'. The insert 40 further includes a peripheral recess 42' interacting with an internal bead 41' of the application tip 6*c*. In the position of rest, the passage 43' is closed off by a central needle 63*b* integral with a portion 63*a* of the application surface. By virtue of the elasticity of the material from which the tip 6*c* is made, this portion 63*a* is capable of lifting under the thrust of the product, and of closing the passage 43' again instantaneously and in a sealed fashion when dispensing ceases, in order to prevent the surrounding air from coming into contact with the product. The product P is thus protected against dirt and oxidation. In this case, the tip 6*c* also acts as a protective cap.

Figure 8:
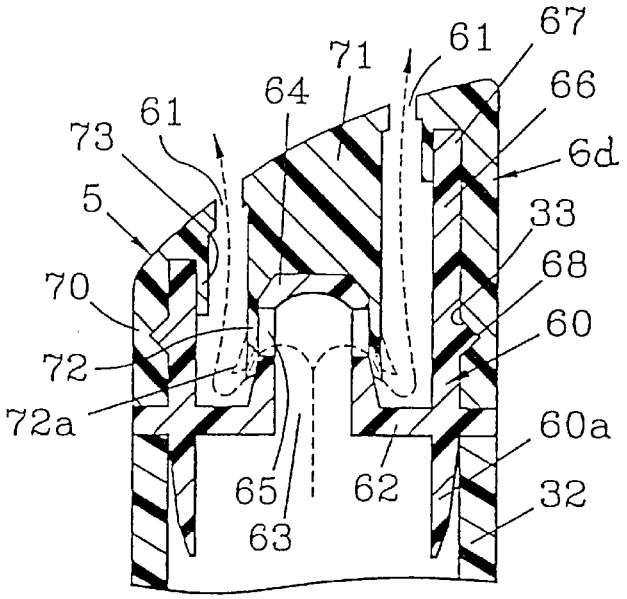
FIG. 8 is a view in longitudinal section of an alternative to the tip of FIG. 7, including another type of one-way dispensing valve.

FIG. 8 represents an application tip 6*d* made in polyethylene elastomer and including an alternative one-way dispensing valve 64, 65, 72. In this Figure there is mounted on the neck 32 of the reservoir a nozzle 60 of cylindrical overall shape, including a circular disc 62 equipped with a central orifice 61. On the side pointing towards the neck, this disc 62 includes a cylindrical sealing skirt 60*a* which is forcibly inserted into the neck 32. On the opposite side from the neck 32, the disc 62 has a central dome 64 situated in the extension of the orifice 61 and forming a blind hole. The dome 64 has one or more radial orifices 65. The disc 62 is further equipped with a cylindrical skirt 66, the free end of which is cut into a slope. This skirt 66 has an annular bead 33 capable of interacting with a complementary annular groove 68 with which the internal cylindrical wall 70 of the application tip 6*d* is equipped. This tip 6*d* has a slightly convex application surface 63 on which there may be found dispensing orifices 61 arranged in a circle. The application surface 63 includes, on the side turned towards the disc 62, a sealing skirt 73 pressing in a sealed fashion into the skirt 66 borne by the disc 62. On the same side, a central thimble element 71 integral with the application surface 63 extends towards the disc 62 to surround the dome 64 completely. This thimble element 71 includes an elastic cylindrical skirt 72 covering the orifices 65, capable of moving away from these orifices under the thrust of the product and of returning instantaneously to the closed position when dispensing ceases.

Figure 1:
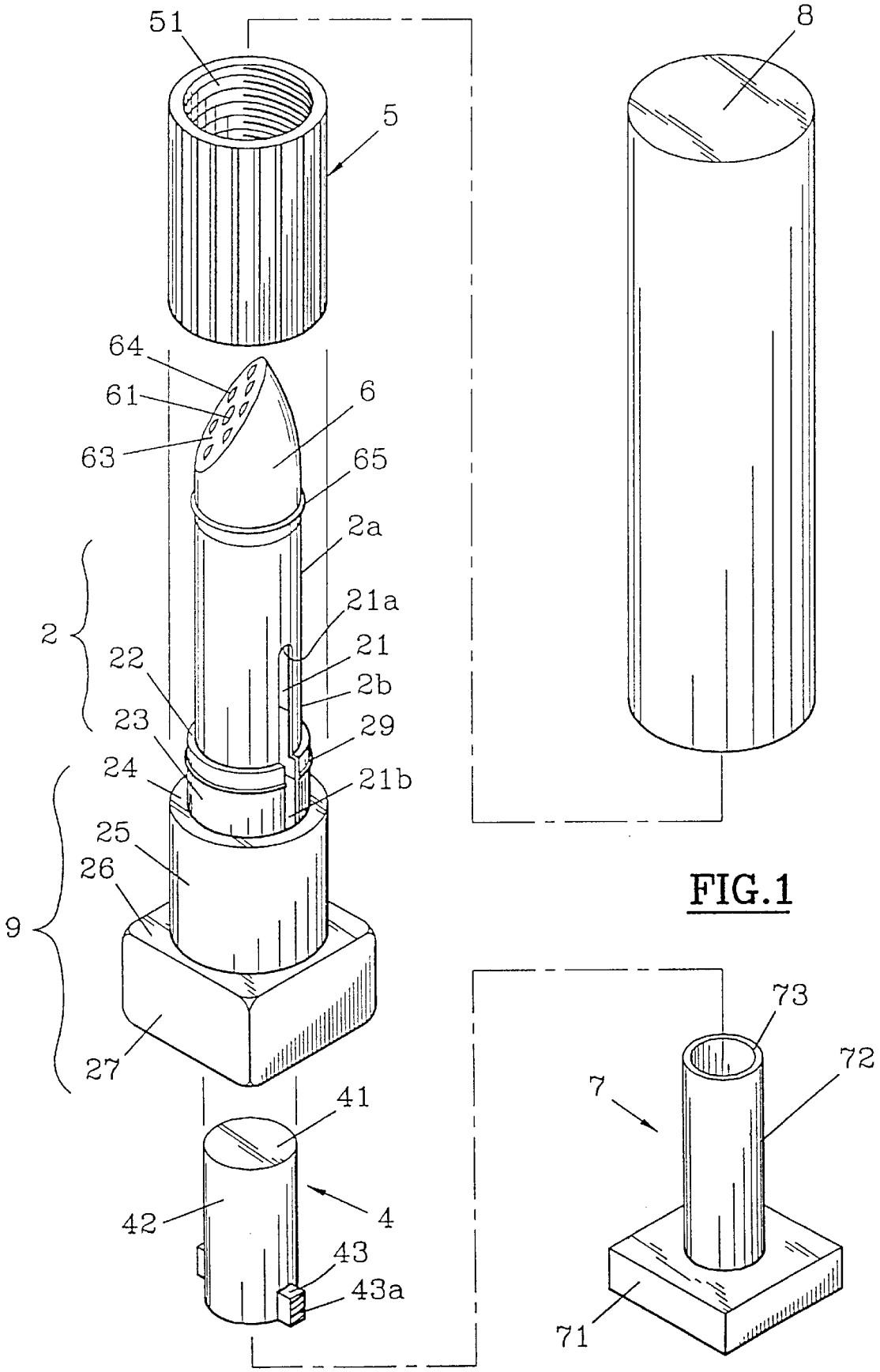
FIG. 1 is an exploded perspective view of the dispensing unit in accordance with the invention, for dispensing a product of liquid-to-pasty consistency.

FIGS. 9 to 16 represent several embodiments of the application tip according to the invention, in which the same constituent elements or elements playing a similar role, bear the reference numerals of FIG. 1.

Figure 9:
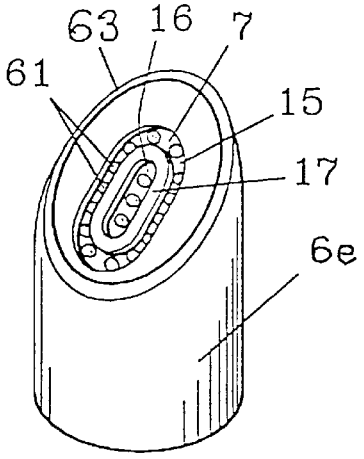
FIGS. 9 to 16 show, in perspective, various alternative embodiments of the dispensing tip which may be part of the dispenser of FIG. 1.

FIG. 9 represents an application tip 6*e* including an application surface equipped with a groove 15 of oval shape and with an elongate cavity 16 located along the major axis of the oval groove, defining an oval cross-section 17. At the bottom of the groove 15 and of the cavity 16 there are evenly distributed dispensing orifices 61.

According to one embodiment, not represented, the application surface 63 may include at least one region equipped with roughnesses, so as to obtain a grained surface, making it easier to spread out the product. The region equipped with roughnesses may, for example, be the oval section 17 of FIG. 9.

Figure 10:
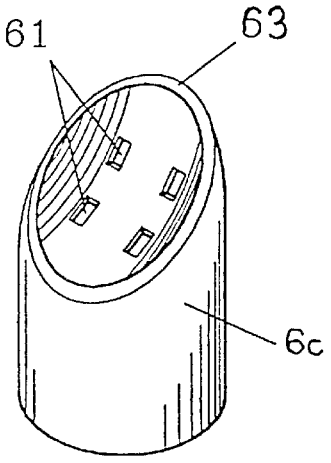

FIG. 10 shows, in perspective, the application tip 6*c* of FIG. 7, exhibiting a concave application surface 63 equipped with four dispensing orifices 61.

Figure 11:
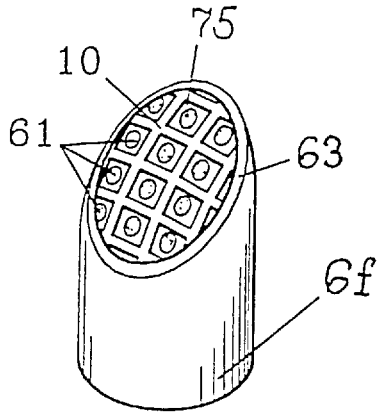

FIG. 11 shows, in perspective, an application tip 6*f* whose application surface 63 includes a mesh 10, of which the spaces, of square shape, form cavities or grooves 75 at the bottom of which the dispensing orifices 61 conveying the product P are formed.

Figure 12:
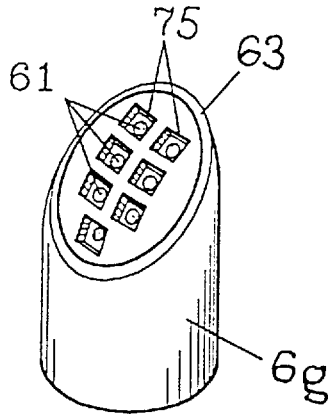

FIG. 12 represents an alternative 6*g* to the tip of FIG. 11, in which the cavities 75 are of the same type as those of the tip 6*f* of FIG. 2, but arranged differently.

Figure 13:
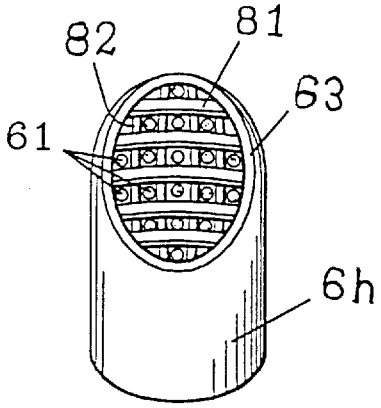

FIG. 13 shows a tip 6*h*, the application surface 63 of which has two series of parallel strips, the strips 81 of a first series substantially forming a right angle with those 82 of a second series and are situated at a different level. These strips thus define an application grid. These strips may optionally be arranged in a woven configuration (alternation of the overlapping of two series of strips 81, 82).

Figure 14:
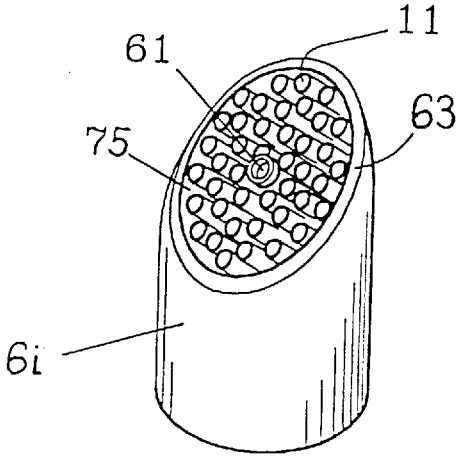

FIG. 14 shows a tip 6*i* including an application surface 63 equipped with a central dispensing orifice 61 surrounded by a multitude of points 11. Thus, cavities 75 which communicate with each other are formed between the cylindrically shaped points. The inter-point gaps define channels 7.

Figure 15:
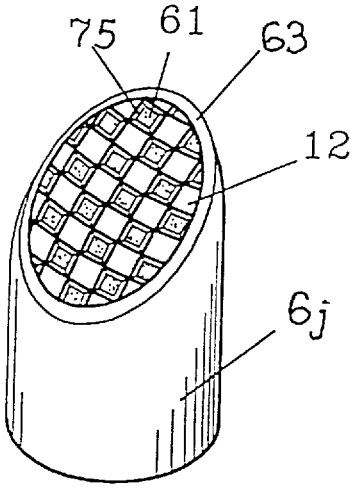

FIG. 15 shows an application tip 6*j*, the application surface 63 of which includes points 12 of square cross-section, alternating with cavities 75 of square cross-section at the bottom of which dispensing orifices 61 are formed. There is a passage between one cavity and the neighboring cavities, along the diagonal of the cross-sections of the cavities 75, defining channels for the product.

Figure 16:
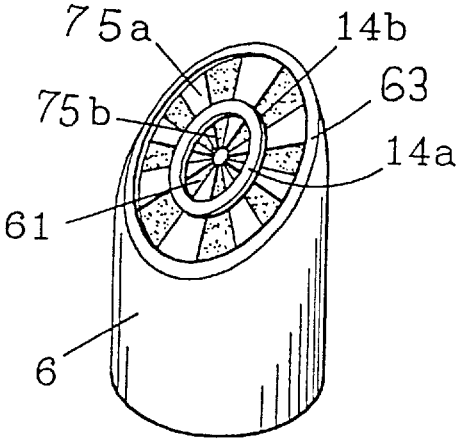

The application tip 6*k* according to FIG. 16 has an application surface formed by two concentric rings 14*a*, 14*b*, at the bottom of which radial strips 75*a*, 75*b* are arranged, the spaces between these strips constituting orifices 61 for dispensing the product.

I claim:

1. Unit for dispensing and applying a product of liquid-to-pasty consistency, comprising a tubular reservoir (2) for containing product to be dispensed, communicating with at least one dispensing orifice (61), said reservoir, on the opposite side to the orifice (61) including at least one longitudinal slot (21) having an upper end (21*a*) and a lower end (21*b*); a piston (4) capable of sliding in translation inside the reservoir (2) including first drive means (43) which passes through the slot (21) and providing for the dispensing of the product; a base part (9) connected to the reservoir; and second means (5) for translational drive of the piston (4); wherein said reservoir (2) and said base part (9) are made as a single piece, the slot being produced on just part of the reservoir, said unit further comprising an application tip (6, 6*a* to 6*k*) which is connected to the reservoir and is equipped with the said dispensing orifice (61), said second drive means (5) being rotatively mounted with respect to said base part and comprising exposed graspable surfaces, whereby said piston can be displaced within said reservoir by a one-handed operation of grasping said graspable surfaces and manipulating said second drive means (5), without changing an orientation of said application tip.

2. Unit according to claim 1, wherein the second drive means comprise an operating ring (5) surrounding at least part of the reservoir and mounted so that it is fixed in terms of translation and free in terms of rotation about this reservoir, the ring (5) being internally equipped with a helical drive element (51), and the first drive means including a complementary drive element (43) integral with the piston (4) passing through the slot (21) and capable of sliding in translation inside the slot, the helical drive element (51) and said complementary drive element (43) being arranged so that a rotation of the operating ring (5) effects a translation of the piston (4) to dispense a dose of product.

3. Unit according to claim 1, wherein the base part (9) has, on an inside, at least one region (25) of greater cross-section than the reservoir so as to form limit stop means and to allow the first drive means (43) of the piston (4) to pass into the slot (21), the region being extended as far as the slot.

4. Unit according to claim 2, further comprising retaining means (7) for preventing the first drive means (43) of the piston (4) from coming out of the slot (21).

5. Unit according to claim 4, wherein the base part (9) has an open end (28), the retaining means consisting of a plug (7) sealing off this end (28), the plug (7) supporting a skirt (72), a free end (73) of which extends to a level of the limit stop means (22).

6. Unit according to claim 2, wherein the helical driving element comprises an internal screw thread (51) of the ring (5) and the complementary drive element (43) comprises an external screw thread (43*a*) borne by the piston (4), the external screw thread (43*a*) conforming to the internal screw thread (51) of the ring (5).

7. Unit according to claim 1 wherein the helical drive element (51) consists of at least one helical groove made in the internal wall of the ring (5); and the complementary drive element (43) consists of at least one stud borne by the piston (4), the stud being capable of sliding in the said groove.

8. Unit according to claim 1 wherein the piston (4) has a cylindrical skirt (42) equipped with a circular wall (41) in contact with the product, the complementary drive means (43) on the opposite side to the product being arranged so that, when complementary drive means (43) are situated at the lower end (21*b*) of the slot (21), the circular wall (41) of the piston is situated above the upper end (21*a*) of the slot (21) to provide for sealing.

9. Unit according to claim 1, wherein the application tip (6, 21 to 29) is shaped substantially into the shape of an ogive equipped with one of a flat and slightly domed application surface (63), situated at an angle on the flank of the ogive, equipped with the dispensing orifice.

10. Unit according claim 1 wherein the application tip (6, 6*a* to 6*k*) includes a closure system (62*a*, 62*b*) which opens under the thrust of the product, and which prevents the surrounding air from entering the reservoir (2), when there is no dispensing taking place, and which instantaneously halts the flow of the product after dispensing.

11. Unit according to claim 1, wherein the application tip (6, 6*a* to 6*k*) includes an application surface provided with one of at least one cavity and at least one groove, the orifice (61) being situated in one of the cavity and the groove (75).

12. Unit according to claim 11, wherein one of the cavity and the groove extends parallel to the application surface (63) by passages (8) so as to create channels in which the product can spread out when it is applied to the support.

13. Unit according to claim 1, wherein the application tip (6, 6*a* to 6*k*) being made of a supple substance.

14. Unit according to claim 1 wherein the application tip (6, 6*a* to 6*k*) is made of an elastomeric material chosen from the group comprising elastomers of one of polyethylene, of polyurethane, and of polyester; polyether-block-amides; polyvinyls; terpolymers of ethylene, of propylene and of a diene (EPDM); styrene-butadiene block copolymers (SEBS-SIS), silicones, nitrile rubbers, and latexes.

15. Unit according to claim 14, wherein the elastomeric material has a hardness lying within the Shore A range from 40 to 70.

16. Unit according to claim 11 wherein the application surface (63) is flat.

17. Unit according to claim 11 wherein the application surface (63) is convex.

18. Unit according to claim 11 wherein the application surface (63) is concave.

19. Unit according to claim 11 wherein the application surface (63) consists of a mesh (10).

20. Unit according to claim 19, wherein the application surface (63) includes two series of woven threads, the threads of one series crossing over those of another series.

21. Unit according to claim 11 wherein the application surface (63) includes a multitude of points (11) separated by a multitude of cavities communicating with one another, at least some of the cavities being equipped with at least one dispensing orifice (61).

22. Unit according to claim 1 wherein the application tip (6, 6*a* to 6*k*) is equipped with an application surface (63) including evenly distributed roughnesses.

23. Unit according to claim 12 wherein the channels are one of straight and curved.

24. Unit according to claim 1 wherein the product is a cosmetic composition.

25. Unit according to claim 1 wherein the product is a composition for the lips, having a liquid-to-pasty consistency.

26. Unit according to claim 1 wherein the product to be dispensed has a viscosity lying within the range ranging from 0.6 Pa.s to 17 Pa.s.

27. Unit for dispensing and applying a product of liquid-to-pasty consistency, comprising a tubular reservoir (2) for containing product to be dispensed, communicating with at least one dispensing orifice (61), said reservoir, on the opposite side to the orifice (61) including at least one longitudinal slot (21) having an upper end (21*a*) and a lower end (21*b*); a piston (4) capable of sliding in translation inside the reservoir (2) including first drive means (43) which passes through the slot (21) and providing for the dispensing of the product; a base part (9) connected to the reservoir; and second means (5) for translational drive of the piston (4); wherein said reservoir (2) and said base part (9) are made as a single piece, the slot being produced on just part of the reservoir, said unit further comprising an application tip (6, 6*a* to 6*k*) which is connected to the reservoir and is equipped with the said dispensing orifice (61), said second drive means (5) being rotatively mounted with respect to said base part and comprising exposed graspable surfaces, whereby said piston can be displaced within said reservoir by a one-handed operation of grasping said graspable surfaces and manipulating said second drive means (5), without changing an orientation of said application tip, the application tip (6, 6*a* to 6*k*) including an application surface having one of at least one cavity and at least one groove, the orifice (61) being situated in one of said cavity and in said groove (75), the application tip (6, 6*a* to 6*k*) being made of a supple substance.

* * * * *